United States Patent [19]

Leese et al.

[11] Patent Number: 4,715,530

[45] Date of Patent: Dec. 29, 1987

[54] TWO-PART MAILER WITH RETURN ENVELOPE

[75] Inventors: David J. Leese, Indianapolis, Ind.; Robert E. Ashby, Quakertown, Pa.

[73] Assignee: Moore Business Forms, Inc., Glenview, Ill.

[21] Appl. No.: 25,724

[22] Filed: Mar. 13, 1987

Related U.S. Application Data

[63] Continuation-in-part of Ser. No. 834,765, Feb. 28, 1986, abandoned.

[51] Int. Cl.[4] ..... B65D 27/06

[52] U.S. Cl. ..... 229/73; 229/69

[58] Field of Search ..... 229/73, 68 R, 69, 71, 229/92, 92.1, 92.3

[56] References Cited

U.S. PATENT DOCUMENTS

| | | | |
|---|---|---|---|
| 3,428,237 | 2/1969 | Dowen | 229/69 |
| 3,437,259 | 4/1969 | Steidinger | 229/73 |
| 3,554,438 | 1/1971 | Van Malderghem | 229/73 |
| 3,905,545 | 9/1975 | Juszak et al. | 229/73 |
| 4,055,294 | 10/1977 | Traise | 229/73 |
| 4,380,315 | 4/1983 | Steidinger | 229/73 |
| 4,384,670 | 5/1983 | Dicker | 229/73 |
| 4,418,865 | 12/1983 | Bowen | 229/69 |

*Primary Examiner*—Willis Little

*Attorney, Agent, or Firm*—Cushman, Darby & Cushman

[57] ABSTRACT

The business or other institution is provided with two complementary series of blank form parts. One of these contains one or more elements of a form of construction (multiple ply, window, glassine-patched window, glue spots, patches or strips) which would make it incompatable for use with today's commercially predominate non-impact printers. The other contains none of such elements and is suited for being run through a business computer-controlled non-impact printer for the purpose of printing of variable information thereon, and of being thereafter assembled and united increment for increment with form parts from the first series, using presently available assembling and uniting apparatus, whereupon the united forms may be successively severed into thus individualized communications and dispatched to their respective addresses.

44 Claims, 10 Drawing Figures

Fig. 3
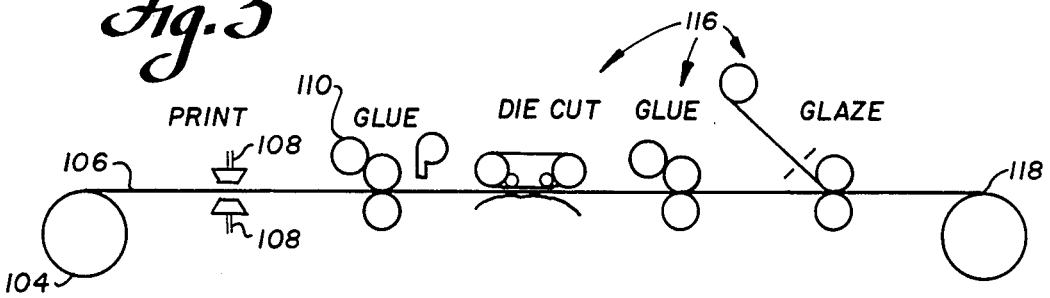
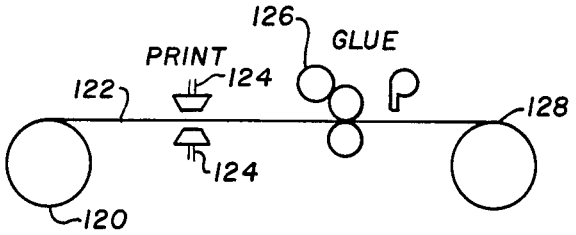
Fig. 4
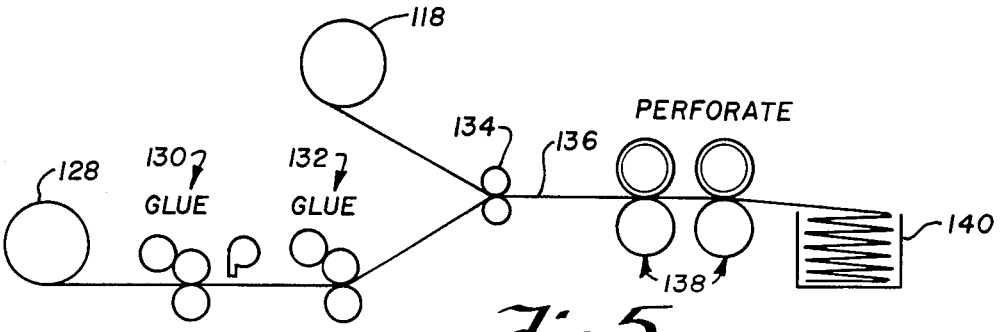
Fig. 5
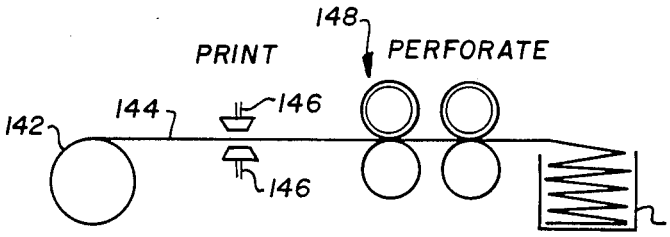
Fig. 6

TWO-PART MAILER WITH RETURN ENVELOPE

REFERENCE TO RELATED APPLICATION

This is a continuation-in-part of the copending U.S. application of Leese, Ser. No. 834,765, filed Feb. 28, 1986, which was abandoned in favor hereof.

BACKGROUND OF THE INVENTION

As a considerable contribution to convenience and efficiency of businesses and other institutions which have the recurring occasion to send variable information to a plurality of customers, clients or patrons, business forms have been developed which often include preprinting on the forms of fixed information (including fixed information about the sender, detailed step-by-step instructions as to how the recipient is requested to respond to reception of communication embodied in and on the form, and graphic and/or verbal highlighting of the fields, zones or areas where variable information will have been provided on the form by the business before sending it to the recipient) and/or variable information is to be placed on some part of the received form by the recipient. Such forms also often include a return envelope and a remittance stub which are detachably provided for the convenience of the recipient in responding as requested by the sender.

With the continuing development of computers, now useful in business at all levels from the multinational giants down to the mom and pop corner grocery, and the continuing proliferation of peripheral equipment which is designed to be operated interactively with, or driven by such business computers, it represents a continuing challenge to the talents and resourcefulness of the designers and manufacturers of business forms to avoid having some advance made in these other fields detract from the usefulness, salability and business-perception of convenience and enhanced efficiency represented by such business forms.

It is as if there is a kind of friendly warfare being pursued, in which any strong advance made in business computers and peripherals aimed at making such equipment and associated software better and more useful to more businesses is likely to expose the need for conception and development of a new generation of business forms. Of course some times it is a leap in the conception and development of business forms that draws out a response from the innovators of computers, peripheral equipment and software. Nevertheless, in both cases, when the two sides respond creatively, society is the beneficiary of each round of conception and development.

It is in the course of such a round of conception and development that the present invention arose:

A further feature of many business forms is that variable information is applied to them by computer-contolled printing apparatus, e.g. so as to apply the recipient's name and address, account number, previous balance, payments and other credits, interest, new debits,, new balance, new amount due, statement date, payment due date and the like. Often this is facilitated by providing the business with the blank forms in two, three or more parts, each in series multiple with a series of sprocket holes running along one or both side margins. The business or other institution feeds one or more of these series of form parts through printers for variable information, and through a collater or other assembler-/uniter apparatus for creating assembled, individualized communications which are successively detached and dispatched to the various addresses. Whereas in an early generation, such series of forms or form parts were variably-printed on typewriters and similar humanly- or computer-operated impact printers with paper drive sprockets on their bails, and in a successive generation with endless-chain, daisy wheel, dot matrix and other advanced, higher-speed impact-type printers, more recently the state-of-the-art for business printing of statements, invoices, solicitations and the like has come to include ink jet printers, laser-using ink jet printers and other non-impact-type printers (NIPs). Such printers, while they are not capable of displacing impact-type printers for every task (e.g. because of the need, or desire, sometimes to print on two or more layers of sheets simultaneously, or to print only on one or more inner sheets while they are covered by a sheet on which the information is not to appear), have many advantages the attractions of which are not to be denied. Included among these are speed, reliability, lack of so many moving parts, and the ability to print on an exposed surface without leaving a telltale mechanical imprint on underlying sheets.

For a supplier of business forms, the appearance and proliferation in business use of non-impact printers represents a challenge—how to devise and provide business forms that carry forward the best, most convenient and familiar features that hitherto state-of-the-art business forms have provided, yet accomodate differences necessitated by use of non-impact printers, and even to push outward the frontier of development of business forms so as to make them even more useful and convenient in the age of non-impact printers.

Although further developments in the field of non-impact printers are almost certain to continue to be made and to reach the marketplace embodied in new machines, at present the non-impact printers which seem to be receiving most widespread business acceptance are ones which will not reliably accept multiple part forms (print on preassembled sheet material which is more than one sheet thick all over or in certain regions), nor on sheets which have open die-cut windows, nor on sheets with glassine patch-closed die-cut windows, nor on sheets bearing uncovered strips, patches or spots of glue (adhesive) which is intended to be later activated for use in attaching the sheets to others or to other regions of the same sheets. Part of the restrictions at this stage in the commmercial development of laser-type and other non-impact printers is a sheet feeder problem, part is an ink jet control problem, and some is a heat-generation problem. As to the latter, by way of explanation it may be worth pointing out that as a sheet is being printed on by a laser-type non-impact printer at least in presently commercially available machines, it has been unavoidable as a practical matter to prevent heat produced by the laser beam from prematurely activating one or more regions of glue if glue is previously applied to any part of the sheet. Premature glue activation causes the glue to adhere the form to sheet feeding structures in the non-impact printer, or in assembler/uniter apparatus, or to other sheets, or to foul any of these with transferred glue.

SUMMARY OF THE INVENTION

The business or other institution is provided with two complementary series of blank form parts. One of these contains one or more elements of a form of construction (multiple ply, window, glassine-patched window, glue spots, patches or strips) which would make it incompatable for use with today's commercially predominate non-impact printers. The other contains none of such elements and is suited for being run through a business computer-controlled non-impact printer for the purpose of printing of variable information thereon, and of being thereafter assembled and united increment for increment with form parts from the first series, using presently available assembling and uniting apparatus, whereupon the united forms may be successively severed into thus individualized communications and dispatched to their respective addressees.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 3 is a schematic view of a line for production of a series of top sheets for use in providing successive exemplars of the individualized form shown in FIGS. 1 and 2.

FIG. 4 is a schematic view of a line for production of a series of intermediate sheets for use in providing successive exemplars of the individualized form shown in FIGS. 1 and 2.

FIG. 5 is a schematic view of a line for production of a series of Part 1 form parts from the material produced by the production lines shown in FIGS. 3 and 4.

FIG. 6 is a schematic view of a line for production of a series of bottom sheets for use in providing successive exemplars of the individualized form shown in FIGS. 1 and 2, i.e. for providing a series of Part 2 form parts.

Figures 1, 2:
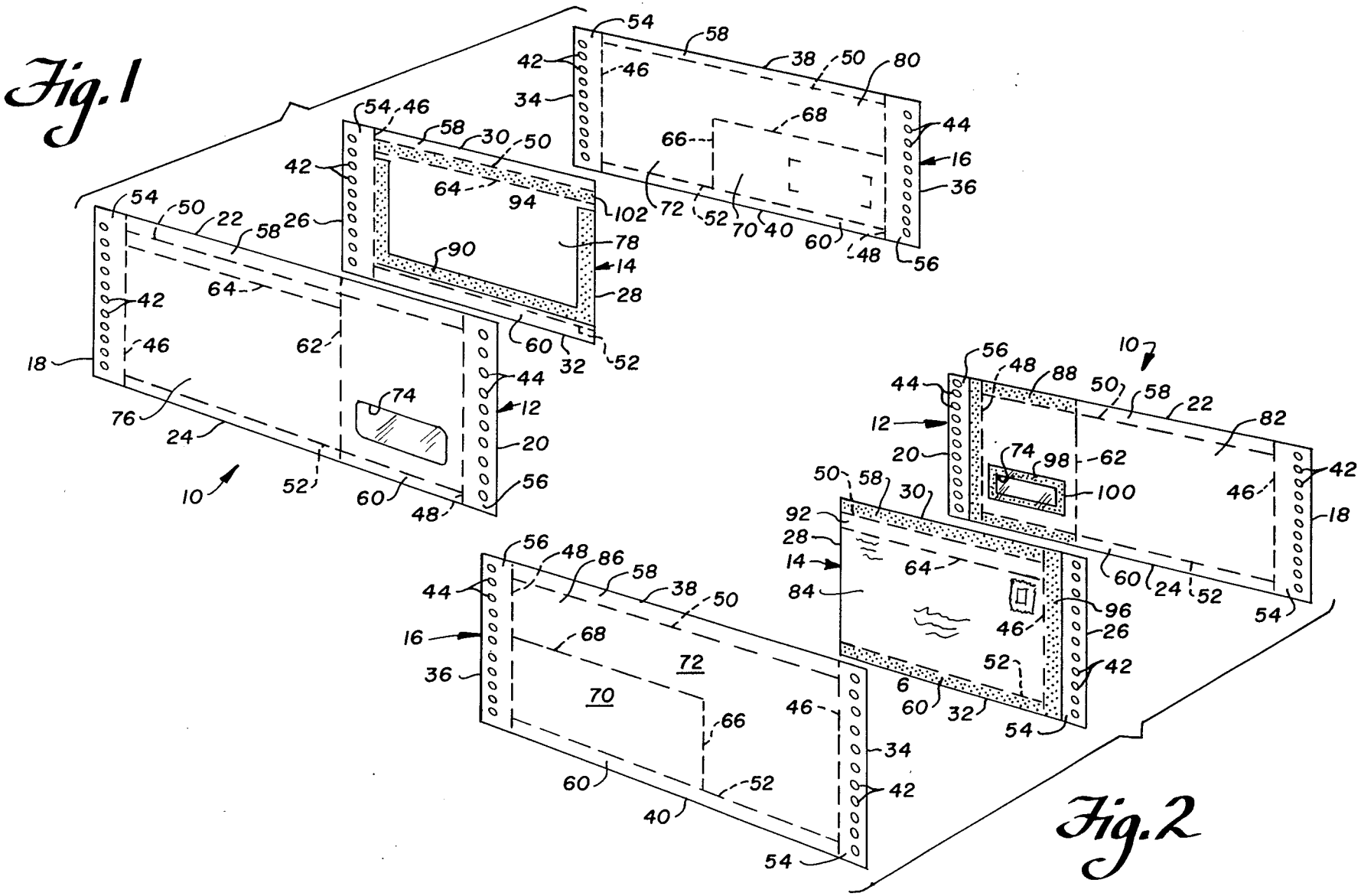
FIG. 1 is an exploded perspective frontal view of the three sheets of an individual form which may be made, assembled and united employing principles of the present invention.
FIG. 2 is a view similar to FIG. 1, but from an opposite (rear) perspective.

DETAILED DESCRIPTION (Each of FIGS. 1 and 2 depicts, for convenience in understanding and convenience in illustration, exploded views of a completed, individualized communication 10 provided in accordance with the principles of the present invention. Because some of the elements that are shown in these views preferably are not applied until a stage at which two of the three sheets have been attached, care should be taken to avoid misinterpreting these views, e.g. so as to gain a mistaken impression that all the features shown preferably are provided before any sheet-to-sheet assembly has taken place.)

The individualized communication 10 that is shown in FIGS. 1 and 2 is made-up of three sheets 12, 14 and 16, which for convenience of description will be respectively termed the top, intermediate and bottom sheets irrespective of their actual spatial orientation during manufacture and use. (Other terms of spatial orientation are similarly arbitrarily used herein unless otherwise indicated in context.)

Each of these sheets is generally rectangular, so that the top sheet 12 has longitudinally running left and right edges 18, 20 and transversally running trailing (top) and leading (bottom) edges 22, 24. Corresponding edges of the intermediate sheet are shown designated 26, 28, 30 and 32; and corresponding edges of the bottom sheet are shown designated 34, 36, 38 and 40.

(By preference, the top, intermediate and bottom sheets of the individualized communication 10 have traveled through respective successive manufacturing processes as respective longitudinally serial increments of sheets of indeterminate length, as is shown in several others of the drawing figures. And it is not until late in the whole process that these webs, after being united as a laminate are severed along coinciding transverse lines of weakness into a plurality of respective individualized communcations 10. In other words, at the coinciding top edges 22, 30 and 38 the individualized communication 10, until a composite web was severed along a respective line of weakness, was joined to another individualized communication 10 (not shown in FIGS. 1 and 2) along the coinciding bottom edges 24, 32 and 40 of the latter, and individualized communication 10, until that composite web was severed along another respective line of weakness, was joined to a third individualized communication 10 (not shown in FIGS. 1 and 2) along the coinciding bottom edges 24, 32 and 40 of the one shown individualized communication 10 and the coinciding top edges 22, 30 and 38 of that third individualized communication 10.)

By preference, the top and bottom sheets are each nominally twelve inches wide and the intermediate sheet is nominally about two-thirds that wide, and all three sheets are arranged to have one side edge e.g. their left side edges coincide. By preference, the three sheets 12, 14 and 16 are made of the same type of paper as is presently used for similar but now conventional business forms made by several manufacturers, notably Moore Business Forms, Inc. For convenience in forms manufacture and business use, the webs of which the top and bottom sheets 12 and 16 are made preferably are conventionally provided with respective marginal rows 42, 44 of sprocket holes running along the left and right edges thereof, and the narrower intermediate sheet 14 is provided with a row (42) of such sprocket holes running along its edge (26) which is to coincide with respective edges (18, 34) of the top and bottom sheets.

Adjacent, but located more centrally of the respective sheets than the rows of sprocket holes 42 just described, the three sheets are shown provided with coinciding longitudinally running lines of weakness 46. And adjacent, but located more centrally of the respective sheets than the rows of sprocket holes 44, the top and bottom sheets 12 and 16 are shown provided with coinciding longitudinally running lines of weakness 48. (The intermediate sheet 14, preferably being narrower than the sheets 12 and 16 preferably has its right edge 28 spaced to the left of, i.e. more centrally of the individualized communication 10 than, the coinciding lines of weakness 48.) The lines of weakness 46 and 48, in common with the other lines of weakness which are to be described herein below preferably are conventionally provided e.g. as respective lines of longitudinally discontinuous slits arranged in series, as respective lines of longitudinally spaced die cut or punched holes arranged in series, or the like.

The individualized communication 10 is shown further including coinciding transverse lines of weakness so formed in all three sheets 12, 14 and 16 adjacent but spaced from the top edges of these sheets. Preferably, the line 50 extends from the line 46 to the line 48.

The individualized communication 10 is shown further including coinciding transverse lines of weakness 52 formed in all three sheets 12, 14 and 16 adjacent but spaced from the bottom edges of these sheets. Preferably, the line 52, also extends from the line 46 to the line 48.

The lines of weakness 46, 48, 50 and 52 define with the correspondingly adjacent edges of the respective sheets respective left, right, top and bottom marginal strips 54, 56, 58 and 60.

The top sheet 12 is shown provided with a longitudinally running line of weakness 62 which at least generally coincides with the right edge 28 of the intermediate sheet 14. This line of weakness 62 is shown running the full height of the top sheet 12.

The top sheet 12 and the intermediate sheet 14 are shown both provided with coinciding transversally running lines of weakness 64 which extend between the left marginal strips 54 and the line of weakness 62/right edge 28.

Optionally, but preferably, the region of the bottom sheet 16 that lies centrally of its marginal strips 54, 56, 58 and 60 is further subdivided e.g. by longitudinally and transverse lines of weakness 66 and 68 to provide what will become a remittance stub 70 and a reminder 72. (In theory, the lines 66, 68 could be omitted and all of the region 70/72 could serve as a remittance stub, which in such a case would need to be folded before it could be placed in a reply envelope. However, it is preferred that the smaller remittance stub 70 be provided for both in order to make proper response easier for the recipient of the individualized communication to make, easier for the return envelope to be reliably opened, without damage to contents, by automated envelope slitting and opening equipment, and easier for remittance stubs to be reliably read by automated optical character reading equipment.) By preference, the remittance stub 70 is located in the lower right corner of the region 70/72, contiguous with the lines of weakness 48 and 52.

Laterally between the lines of weakness 62 and 48, and preferably coincident with a central region of the remittance stub 70, the top sheet 12, e.g. in its lower half and near its lower right corner is provided with a die-cut window 74 of conventional size, shape and orientation.

(For convenience in description, the faces 76, 78 and 80 of the sheets 12, 14 and 16 shown in FIG. 1 will be designated their fronts, and their faces 86, 84 and 82 shown in FIG. 2 will be designated their rears.)

On the rear face 82 of the top sheet 12 a ring of adhesive 98 is provided marginally of the die-cut window 74. This adhesive 98 adheres a patch 100 of highly translucent, or transparent flexible sheet material (e.g. glassine, cellophane, acetate, polyethylene terephthalate or the like, generically termed 'flexible glazing' herein).

The top and intermediate sheets are shown further provided with adhesive in lines, fields of dots, stripes or the like (generically termed 'bands' herein) as will now be described:

The rear face of the top sheet 12 is provided with squared C-shaped band of adhesive 88 on its marginal strips 58, 56 and 60, only to the right of the intermediate longitudinal line of weakness 62. By preference, this adhesive is a heat-activated (heat-seal, hot-melt) adhesive.

The front face of the intermediate sheet, 14, inwardly bordering its left marginal strip 54, its lower marginal strip 60 and its right edge 28 with a squared C-shaped band of adhesive 90. By preference, this band of adhesive is a cold glue, and its opposite limbs reach up the line of weakness 64.

The front face of the intermediate sheet 14, on the potential flap 92 thereof which is defined between its transverse lines of weakness 50 and 64, its left longitudinal line of weakness 46 and its right edge 28, is provided with a transversally extending band of adhesive 94. By preference, this band of adhesive is a dried, rewettable adhesive.

The rear face of the intermediate sheet 14 is provided with a squared C-shaped band of adhesive 96 on its marginal strips 58, 54 and 60. By preference, this adhesive is a heat-activated (heat-seal, hot-melt) adhesive.

(The adhesive bands 88 and 96 are complementary to one another so that upon superimposition of the top and intermediate sheets, these two bands together form a complete hollow-rectangular marginal band 88/96 of adhesive.)

No adhesive is provided on the bottom sheet.

Although much variation in printing on the various sheets is possible within the scope of the invention, there will now be described in relation to FIGS. 1 and 2 a typical layout of printing on the front and rear faces of the top, intermediate and bottom sheets:

The front of the top sheet is printed with non-varying verbal and non-verbal graphics, typically including a set of instructions on the four marginal strips as to how, and the order in which these strips 54–60 are to be severed from the individualized communication 10 along the respective lines of weakness 46–52, postal class statement, frank or stamp outline, marginal identification of product name and supplier, and opacification field for obscuring contents first of the individualized communication and second of the return envelope from view from exteriorly thereof.

The rear face of the top sheet 12 is printed with non-varying verbal and non-verbal graphics, typically including a first set of instructions, located over the patched window, e.g. to instruct the recipient to use the return envelope to make a remittance, but to detach the stub containing the patched window before mailing the return envelope; also including a second set of instructions, located on the discard strip 102 (which coincides with the potential flap 92), e.g. to instruct the recipient to remove the strip 102 by severing along the line of weakness 64 on the top sheet 12 in order to expose the otherwise-coated front face of the potential flap 92, so it can be moistened, bent over on the line 64 of the intermediate sheet and sealed to the front face of the top sheet 12 to close the return envelope. Further, the rear face of the top sheet 12 may contain opacification fields for obscuring contents first of the individualized communication and second of the return envelope from view from exteriorly thereof.

The front face of the intermediate sheet 14 is printed with non-varying verbal and non-verbal graphics, typically including a set of instructions on the potential flap 92 ihstructing the recipient to moisten, fold and seal this strip once its front face has become exposed by removal of the discard strip 102; and an opacification field for obscuring contents of the return envelope from view from exteriorly thereof.

The rear face of the intermediate sheet 14 is printed with non-varying verbal and non-verbal graphics, typically including a set of instructions on the potential flap 92 indicating that it should not be removed but how it should be used; a set of upper left corner lines for the remitter to use in providing a return address; a stamp outline in the upper right corner to remind the remitter to apply postage (or a frank where return postage is to be paid by the original business sender/remittee; and a lower/centrally located postal address for the original business sender/remittee.

The front face of the bottom sheet 16 may be printed with non-varying verbal and non-verbal graphics typical of a blank form for an invoice, a statement of account, a solicitation of funds for a charitable or other institution or the like and typical of a remittance stub, together with sets of instructions e.g. instructing the recipient to detach the remittance stub 70 from the remainder 72 along the lines 66, 68, and to return the remittance stub in a non-folded condition with a remittance, in the return envelope, to the remittee, while retaining the remainder 72 for the remitter's records.

The front face of the bottom sheet 16 includes among its preferably pre-printed non-verbal graphics various outlined zones, areas, boxes or the like (generically termed 'fields') labeled for reception of variable verbal graphics (e.g. quantities, amounts, dates, descriptions, totals, amounts due, categories, codes, intervals, due date, debits, credits, and particularly including a field on the remittance stub coincident with the window 74 for reception of the recipient's name, postal address and associated coding e.g. customer account number and/or postal carrier route presort information).

The above listings of printed constant information are exemplary and can be added to, subtracted from and changed for suiting particular businesses and other institutions and the type of communication. What is fundamentally important is that the information provided by printing on the top and intermediate sheets be largely or entirely constant information, and that the bottom sheet 16 at the time of its initial acquisition by the business or other institution, be free of adhesive, windows, patches, multiple thicknesses or any other feature which would make it incompatable for use with today's commercially important high-speed non-impact printers, such as an HP Laserjet Printer.

Some of today's commercially important high-speed non-impact printers, such as an HP Laserjet Plus Printer are capable of printing non-verbal graphics, so it is possible and within the purview of the invention that some or all of the constant information (as well as the variable information) which would be needed for the bottom sheet 16 would be applied by the business or other institution using its non-impact printer, rather than being pre-printed by the manufacturer of the form parts.

Turning now to FIGS. 3–6, preferred processes will be described for creation of the form parts 1 and 2, in webs of indeterminate length.

Part 1 of the form is a composite web made of two webs which have been laminated together. A process for providing the top web of this composite is illustrated in FIG. 3; a process for providing the other web of this composite (which will provide the intermediate sheet 14 of the individualized communication 10) is shown in FIG. 4; and a process for laminating these two webs is shown in FIG. 5. Part 2 of the form is a singular web, a process for the production of which is illustrated in FIG. 6.

In FIG. 3, a roll 104 of top sheet stock material is shown being unrolled to provide a web 106 which is advanced successively through a printing station 108 so that constant matter can be printed on one or both sides, as appropriate, a glue application station 110, e.g. for application of the glue band 88, a die-cutting station 112, e.g. for cutting of the window 74, a glue application station 114, e.g. for application of the glue band 98, and a window patching station 116, e.g. for application of the patch 100, successively to each increment of the web 106 that will later become part of a respective individualized communication 10. Then the completed top web is rolled-up at 118.

In FIG. 4, a roll 120 of intermediate sheet stock material is shown being unrolled to provide a web 122 which is advanced successively through a printing station 124 so that constant matter can be printed on one or both sides, as appropriate and a glue application station 126, e.g. for application of the glue band 96. Then the intermediate web is rolled up at 128.

In FIG. 5, the top web roll is shown being unrolled at 118, and the intermediate web roll is shown being unrolled at 128 to provide respective webs. The intermediate web is advanced successively through a first glue application station 130, e.g. for application of the band of rewettable adhesive 94, and a second glue application station 132, e.g. for application of the band of cold glue 90, and a laminating station 134, where the active cold glue 90 is used for adhering the top and intermediate webs together thus creating a Part 1 composite web 136.

Inasmuch as in the preferred embodiment the only places where the broader top web is to receive a line of weakness that does not coincide with a line of weakness that is to be received by the intermediate web are located laterally beyond the edge 28 of the intermediate web, all of the heretofore-described longitudinal and transverse line of weakness for the top web and composite web can be applied to the composite web 136, e.g. at a lines of weakness-providing station 138, whereupon the finished Part 1 composite web may be taken-up and boxed for shipment, as at 140.

In FIG. 6, a roll 142 of bottom sheet stock material is shown being unrolled to provide a web 144, which is advanced successively through a printing station 146 so that constant matter can be printed on one or both sides, as appropriate, and a lines of weakness-providing station 148, whereupon the finished Part 2 web may be taken-up and boxed for shipment, as at 150.

The product of the business form manufacturer is Part 1 and Part 2 as contained in the boxes shown at the right at 140 and 150 in FIGS. 5 and 6. These form parts, typically in boxed web form, are ordered by the business or other institution in desired quantities, which may be different for the two parts, depending on anticipated usage, order size price advantages, anticipated changes needed for either Part, and so on.

The normal sequence of operations for use of form Parts 1 and 2 at the business or other institution, and by the recipient, will now be described with reference to FIGS. 7–9.

Figure 7:
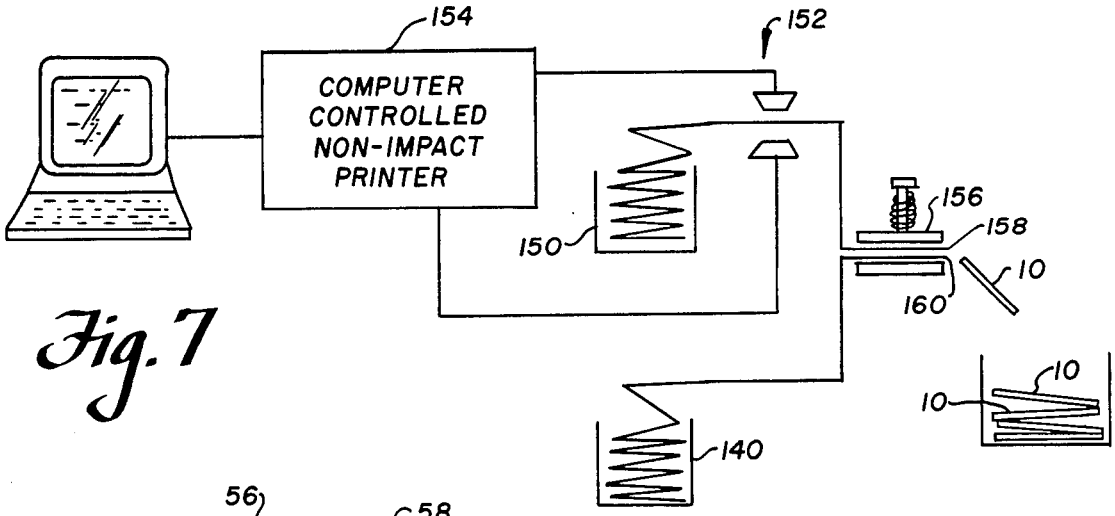
FIG. 7 is a schematic view of a production line at the business or other institution for turning a stock of Part 1 and a stock of Part 2, by means of a business computer-operated non-impact printer, and other equipment, into a succession of individualized communications addressed to intended recipients.

Referring to FIG. 7, at the premises of the business or other institution a stock 150 of Part 2 of the form is fed to the printing station 152 of a computer-controlled non-impact printer 154 at which station respective variable information such as the recipient's addrees, account data and the like (as has been elaborated upon in more details hereinabove in relation to FIG. 1) is applied to each successive increment of bottom sheet 16 of the web. The thus-variably printed Part 2 is then fed to an assembling and uniting (collating and sealing) station 156, at which the front face of each succeeding increment 158 of Part 2 of the form is registered and juxtaposed facewise with the rear face of a respective succeeding increment 160 of Part 1 the form, locally heated to activate the complementary bands of adhesive 88 and 96. Also there is here severed from the leading end of the thus-created three-layer composite web, a succession of individualized communications 10 ready to be mailed to the intended recipients (whose names and addresses now show out through the translucently patched windows 74 of the respective individualized communications 10).

Figure 8:
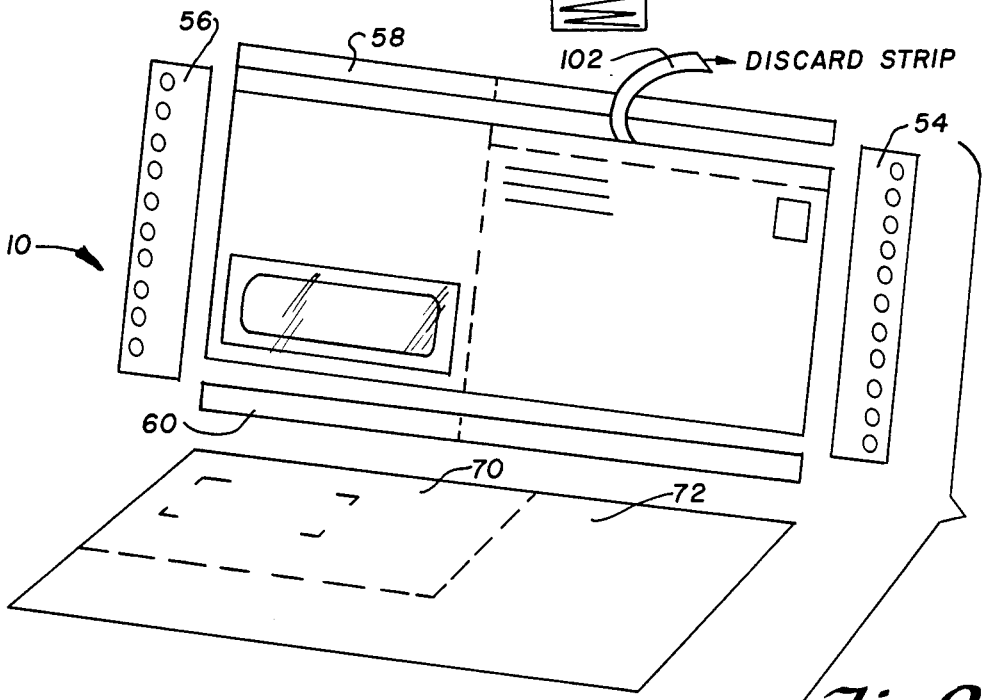
FIG. 8 is an exploded perspective view of the result of opening up of the individualized communication by an intended recipient and removal of various portions from one another preparatory to use of the remittance stub and return envelope in accordance with instructions provide on the individualized communication.
Figure 9:
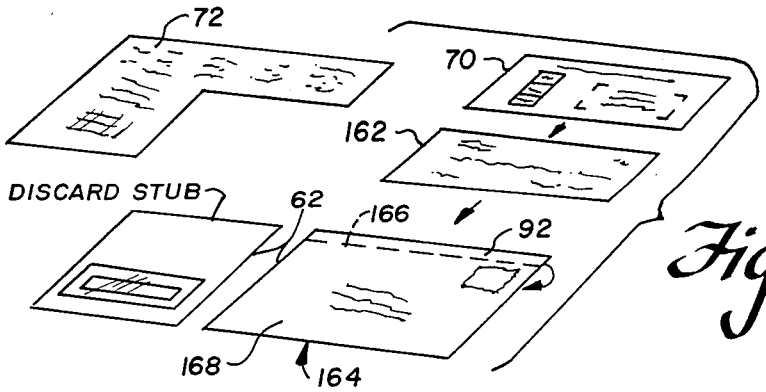
FIG. 9 is an exploded perspective view showing use of the return envelope by the recipient of the individualized communication to send the completed remittance form, with a check, to the business or other institution.

Referring to FIGS. 8 and 9, upon being received by an intended recipient, a respective individualized communication initially presents a set of externally visible printed instructions to the recipient. Upon following these, the recipient severs all four marginal bands 54–60 from the individualized communication 10 causing the remaining central portion 70/72 of the bottom sheet 16 to separate from the remaining central portion of the top sheet 12/intermediate sheet 14 laminate. This exposes the other sets of instructions which have been described hereinabove in relation to FIGS. 1 and 2. Upon following these instructions, the recipient severs the remittance stub 70 from the remainder 72, fills in any information (such as amount of remittance and correction of recipient's address) on the remittance stub, writes a check 162 for the amount of the remittance, removes the discard stub and discard strip from the top sheet 12 along the lines of weakness 62 and 64 (thus freeing the return envelope 164 from-the remainder of the mailer), inserts the completed check 162 and remittance stub 70 into the return envelope 164 through its upwardly opening mouth 166, moistens, bends over along the line 64 of the intermediate sheet 14 and seals to the outside face of the top sheet 12 the flap 92, thereby sealingly closing the return envelope 164, applying a stamp to the return envelope (if it is not franked), and mailing it back to the business or other institution whose name and address are pre-printed oh the front 68 of the return envelope (as is described hereinabove in relation to FIG. 2).

Although a main purpose of the invention is to provide a two part mailer of which one part is compatible with today's commercially predominate non-impact printers whereas the other part contains mainly or exclusively pre-printed constant information, it would be within the purview of the invention for a business to apply some variable information to either or both Parts 1 and 2 of the form, before or after assembling and uniting such parts, using an impact-type printer, i.e. a printer that does not apply such heat to the forms on form parts as would prematurely and deleteriously activate an adhesive provided thereon.

Figure 10:
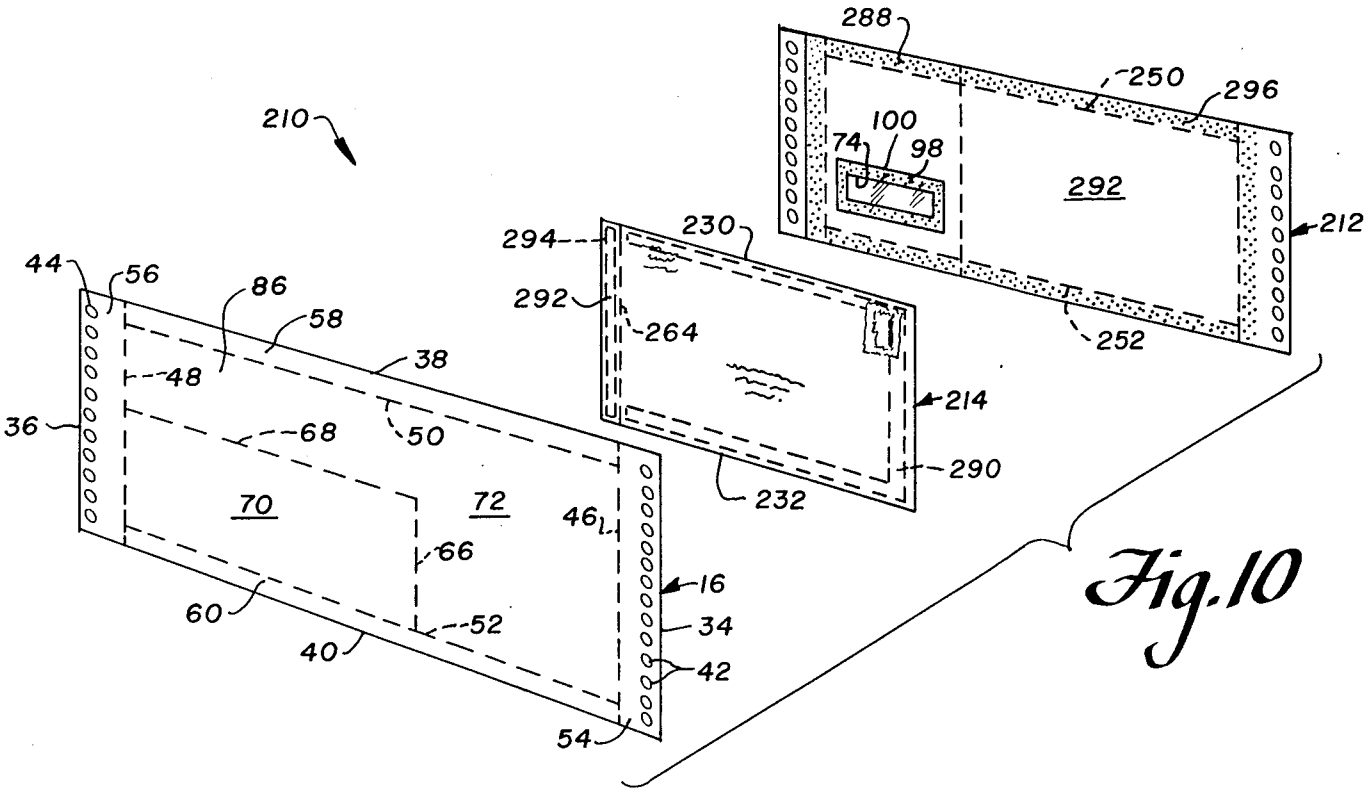
FIG. 10 is an exploded perspective view similar to FIG. 2, of a modified embodiment.

A modified embodiment of a mailer embodying principles of the present invention is now described with reference to FIG. 10. Elements which correspond to those of the previously-described embodiments are given the same numbers in FIG. 10; likewise, nearly similar parts are given the same numbers, raised by 200, and the description is not repeated here.

In effect, the individualized communication 210 shown in FIG. 10 may be identical to the individualized communication 10 which has been previously described, with the exception that upper and lower marginal portions of the paper or paper-like material of which the intermediate sheet 214 is made are cut away, e.g. during the manufacturing process which has been described with reference to FIG. 4, so that its upper and lower margins 230, 232 are respectively located coincident with, or slightly below and above the upper and lower perforation lines 250, 252 of the sheet 212, with at least the upper and lower limbs of the complementary squared C-shaped pattern of adhesive 296 being provided directly on the rear face 282 of the top sheet 212. By preference, in the series of intermediate sheet manufacturing steps shown in FIG. 4, the portion 54 shown in FIG. 2 also is removed, so that the intermediate sheet stock exists as a series of chips, which are pattern pasted in a squared C-shaped pattern 290, open to the right (rather than to the top), and a potential glue flap 292 is provided at the right margin (rather than at the top margin), on a marginal portion defined by a longitudinal perforation line 264. The front face of the potential glue flap 292 bears a band of rewettable glue 294. This feature could also be provided by a transfer tape adhesive strip (not shown). The discard strip 102 is omitted from top sheet 212, if the return envelope is made to open at the right end. Of course, the return envelope of this modified embodiment could be made to open along its upper margin as in the first-described embodiment. In the embodiment that is shown in FIG. 10, the two complementary squared C-shaped bands of adhesive 288 and 296, being provided on the rear face of the topsheet are, in effect, a hollow-rectangular band of adhesive 288/296.

The mailer of the modified embodiment preferably is manufactured and used with a minimum of departures from the details which have been described hereinabove in relation to the first-described species.

It should now be apparent that the two-part mailer with return envelope as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A two-part mailer with a return envelope, comprising:

a first part, including:

a top sheet having a front face and a rear face;

an intermediate sheet having a front face and a rear face;

securement means joining said front face of said intermediate sheet to said rear face of said top sheet along a generally C-shaped band so that a first portion of the top sheet is disposed in facewise juxtaposition with a first portion of the intermediate sheet, with the C-shaped band of securement means defining on these sheets the internal perimeter of a return envelope, with potentially open mouth of such return envelope being defined between opposite limbs of said C-shaped band of securement means;

a second portion of said top sheet adjoining said first portion thereof outside said C-shaped band of securement and extending beyond a perimetrical edge of said intermediate sheet;

means defining a window aperture through said second portion of said top sheet beyond said perimetrical edge of said intermediate sheet;

two complementary C-shaped bands of deactivated, activatable adhesive disposed on said rear faces of said top and intermediate sheets, these two bands being arranged to form a hollow generally rectangular figure which collectively jointly perimetrically rings said return envelope and said window aperture;

at least one field of constant information printed on at least one of said top sheet and intermediate sheet; and a second part, including:

a bottom sheet having a front face and a rear face;

this bottom sheet being of sufficient size and shape as to permit facewise juxtaposition of said two complementary C-shaped bands of adhesive with said front face thereof substantially completely about the perimetrical extent of said generally rectangular figure;

this bottom sheet being adapted to be printed with information including at least one field of variable information located so as to be visible through said window aperture upon such juxtaposition of said two complementary C-shaped bands of adhesive with said front face of said bottom sheet.

2. The two-part mailer of claim 1, wherein:

said top sheet and said bottom sheet are substantially the same in size and outer perimetrical figure.

3. The two-part mailer of claim 2, wherein:

said top sheet, said intermediate sheet and said bottom sheet all are substantially rectangular in outer perimetrical figure, each having a left edge, a right edge, a top edge and a bottom edge;

the top edge, the bottom edge and one of the left and right edges of said intermediate sheet being respectively substantially coincident with the top edge, the bottom edge, the left edge and the right edge of both said top sheet and said bottom sheet.

4. The two-part mailer of claim 3, wherein:

said first part is but one of a plurality of substantially identical such first parts disconnectably connected to one another in a longitudinally extending series, along respective transverse lines of weakness provided at the top and bottom edges of said top sheet and said intermediate sheet.

5. The two-part mailer of claim 4, wherein:

said second part is but one of a plurality of substantially identical such second parts disconnectably connected to one another in a longitudinally extending series along respective transverse lines of weakness provided at the top and bottom edges of said bottom sheet.

6. The two-part mailer of claim 3, wherein:

said second part is but one of a plurality of substantially identical such second parts disconnectably connected to one another in a longitudinally extending series along respective transverse lines of weakness provided at the top and bottom edges of said bottom sheet.

7. The two-part mailer of claim 1, wherein:

said top sheet, said intermediate sheet and said bottom sheet all are substantially rectangular in outer perimetrical figure, each having a left edge, a right edge, a top edge and a bottom edge;

8. The two-part mailer of claim 7, further including:

a patch of translucent material secured to said rear face of said top sheet marginally of said window aperture and providing flexible glazing for said window aperture.

9. The two-part mailer of claim 7, wherein:

said securement means joining said front face of said intermediate sheet to said rear face of said top sheet along said generally C-shaped band is constituted by cold glue.

10. The two-part mailer of claim 7, wherein:

said securement means joining said front face of said intermediate sheet to said rear face of said top sheet along said generally C-shaped band opens toward said top edge of said top sheet and said top edge of said intermediate sheet.

11. The two-part mailer of claim 10, further comprising:

means defining left and right longitudinally extending lines of weakness through said top and bottom sheets and one of a left and a right line of weakness through said intermediate sheet spaced from respective left and right edges of the respective said sheets, respective left lines of weakness being in registry thicknesswise of said first part and said second part upon said juxtaposition of said two complementary C-shaped bands of adhesive with said front face of said bottom sheet, so as to define a left marginal strip, and respective right lines of weakness being in registry thicknesswise of said first part and said second part upon said juxtaposition of said two complementary C-shaped bands of adhesive with said front face of said bottom sheet, so as to define a right marginal strip for said two-part mailer means defining top and bottom transversally extending lines of weakness through said top, intermediate and bottom sheets extending between said left and right marginal strips and being spaced from respective top and bottom edges of the respective said sheets, respective top lines of weakness being in registry thicknesswise of said first part and said second part upon said juxtaposition of said two complementary C-shaped bands of adhesive with said front face of said bottom sheet, so as to define a top marginal strip, and respective bottom lines of weakness being in registry thicknesswise of said first part and said second part upon said juxtaposition of said two complementary C-shaped bands of adhesive with said front face of said bottom sheet, so as to define a bottom marginal strip for said two-part mailer, whereby after said first part and second part have been adhered together by placing them in said juxtaposition with said generally rectangular figure coincident with said left, right, top and bottom marginal bands of said front face of said bottom sheet and activating said activatable, deactivated adhesive, a remaining central portion of said first part may be detached from a remaining central portion of said second part by detaching said left, right, top and bottom marginal strips from the respective said sheets along the respective said left, right, top and bottom lines of weakness.

12. The two-part mailer of claim 11, further comprising:

a further transversally extending line of weakness provided on at least one of said top sheet and said intermediate sheet, this further line of weakness extending between said left or right marginal strip of said intermediate sheet and the respective opposite edge of said intermediate sheet at a level adjacent but spaced below said top marginal strip, thereby providing a discard strip, which, upon removal from said remaining central portion of said first part thereby exposes on the other of said top sheet and said intermediate sheet a potential flap for closing said mouth of said return envelope.

13. The two-part mailer of claim 12, further comprising:

a band of rewettable adhesive provided on said potential flap for sealing closed said mouth of said return envelope.

14. The two-part mailer of claim 13, further including:

a further longitudinally extending line of weakness in said top sheet substantially coincident with where said second portion and said first portion of said top sheet adjoin one another, so that said second portion of said top sheet may be detached from said return envelope.

15. The two-part mailer of claim 11, wherein:

said remaining central portion of said second part is potentially subdividable along further line of weakness means provided thereon into a potential remittance stub and a potential addressee's record.

16. The two-part mailer of claim 15, wherein:

said potential remittance stub is adapted to have said at least one field of variable information non-impact printed thereon.

17. The two-part mailer of claim 16, wherein:

said potential addressee's record is adapted to have a further at least one field of variable information non-impact printed thereon.

18. A two-part mailer with a return envelope, comprising:

a first part, including:

a top sheet having a front face and a rear face;

an intermediate sheet having a front face and a rear face;

securement means joining said front face of said intermediate sheet to said rear face of said top sheet along a generally C-shaped band so that a first portion of the top sheet is disposed in facewise juxtaposition with a first portion of the intermediate sheet, with the C-shaped band of securement means defining on these sheets the internal perimeter of a return envelope, with potentially open mouth of such return envelope being defined between opposite limbs of said C-shaped band of securement means;

a second portion of said top sheet adjoining said first portion thereof outside said C-shaped band of securement and extending beyond a perimetrical edge of said intermediate sheet;

two complementary C-shaped bands of deactivated, activatable adhesive disposed on said rear faces of said top and intermediate sheets, these two bands being arranged to form a hollow generally rectangular figure which collectively jointly perimetrically rings said return envelope and borders said second portion of said top sheet;

at least one field of constant information printed on at least one of said top sheet and intermediate sheet; and a second part, including:

a bottom sheet having a front face and a rear face;

this bottom sheet being of sufficient size and shape as to permit facewise juxtaposition of said two complementary C-shaped bands of adhesive with said front face thereof substantially completely about the perimetrical extent of said generally rectangular figure;

this bottom sheet being adapted to be printed with information including at least one field of variable information located so as to be coincident with said second portion of said top sheet upon such juxtaposition of said two complementary C-shaped bands of adhesive with said front face of said bottom sheet.

19. The two-part mailer of claims 18, wherein:

said top sheet, said intermediate sheet and said bottom sheet all are substantially rectangular in outer perimetrical figure, each having a left edge, a right edge, a top edge and a bottom edge;

20. The two-part mailer of claim 19, wherein:

said securement means joining said front face of said intermediate sheet to said rear face of said top sheet along said generally C-shaped band opens toward said top edge of said top sheet and said top edge of said intermediate sheet.

21. The two-part mailer of claim 20, further comprising:

means defining left and right longitudinally extending lines of weakness through said top and bottom sheets and one of a left and a right line of weakness through said intermediate sheet spaced from respective left and right edges of the respective said sheets, respective left lines of weakness being in registry thicknesswise of said first part and said second part upon said juxtaposition of said two complementary C-shaped bands of adhesive with said front face of said bottom sheet, so as to define a left marginal strip, and respective right lines of weakness being in registry thicknesswise of said first part and said second part upon said juxtaposition of said two complementary C-shaped bands of adhesive with said front face of said bottom sheet, so as to define a right marginal strip for said two-part mailer means defining top and bottom transversally extending lines of weakness through said top, intermediate and bottom sheets extending between said left and right marginal strips and being spaced from respective top and bottom edges of the respective said sheets, respective top lines of weakness being in registry thicknesswise of said first part and said second part upon said juxtaposition of said two complementary C-shaped bands of adhesive with said front face of said bottom sheet, so as to define a top marginal strip, and respective bottom lines of weakness being in registry thicknesswise of said first part and said second part upon said juxtaposition of said two complementary C-shaped bands of adhesive with said front face of said bottom sheet, so as to define a bottom marginal strip for said two-part mailer, whereby after said first part and second part have been adhered together by placing them in said juxtaposition with said generally rectangular figure coincident with said left, right, top and bottom marginal bands of said front face of said bottom sheet and activating said activatable, deactivated adhesive, a remaining central portion of said first part may be detached from a remaining central portion of said second part by detaching said left, right, top and bottom marginal strips from the respective said sheets along the respective said left, right, top and bottom lines of weakness.

22. The two-part mailer of claim 21, further comprising:

a further transversally extending line of weakness provided on at least one of said top sheet and said intermediate sheet, this further line of weakness extending between said left or right marginal strip of said intermediate sheet and the respective opposite edge of said intermediate sheet at a level adjacent but spaced below said top marginal strip, thereby providing a discard strip, which, upon removal from said remaining central portion of said first part thereby exposes on the other of said top sheet and said intermediate sheet a potential flap for closing said mouth of said return envelope.

23. The two-part mailer of claim 22, wherein:

said remaining central portion of said second part is potentially subdividable along further line of weakness means provided thereon into a potential remittance stub and a potential addressee's record.

24. The two-part mailer of claim 23, wherein:

said potential remittance stub is adapted to have said at least one field of variable information non-impact printed thereon.

25. The two-part mailer of claim 24, wherein:

said potential addressee's record is adapted to have a further at least one field of variable information non-impact printed thereon.

26. The two-part mailer of claim 25, wherein:

said first part is but one of a plurality of substantially identical such first parts disconnectably connected to one another in a longitudinally extending series, along respective transverse lines of weakness provided at the top and bottom edges of said top sheet and said intermediate sheet.

27. The two-part mailer of claim 26, wherein:

said second part is but one of a plurality of substantially identical such second parts disconnectably connected to one another in a longitudinally extending series along respective transverse lines of weakness provided at the top and bottom edges of said bottom sheet.

28. A method of providing an individualized communication, comprising:

providing a first form part that includes a return envelope having a discard stub extending to one side thereof and four detachable marginal strips bordering the return envelope and discard stub in common, the return envelope being pre-addressed with a return address on one-face thereof and the four marginal strips on a face of each corresponding to said one face bearing an activatable, deactivated adhesive;

providing a second form part which is but a single sheet in thickness and lacks any feature incompatible with providing variable printing thereon using a non-impact printer;

prior to uniting said first and second form parts, printing variable information on at least one face of said second form part using a non-impact printer;

juxtaposing said one face of each of said four marginal strips with said one face of said second form part; and while maintaining such juxtaposition, activating said activatable, deactivated adhesive thereby locally securing said first and second form parts together so that said second form part obscures the return address on the return envelope, and the first form part obscures at least part of the variable information which has been non-impact printed on the second form part.

29. The method of claim 28, wherein:

at least until said juxtaposing step is performed, said first form part is but one of a longitudinally extending series of like first form parts severally connected to one another along respective transverse lines of weakness;

said second form part is but one of a succession of like second form parts each of which, in the course of conducting said printing step in respect thereto is provided by a non-impact printer with variable information at least some of which differs among all said second form parts; and in connection with conducting said juxtaposing and activating steps as to corresponding ones of said first and second form parts said first form parts are successively severed from said series.

30. The method of claim 29, wherein:

the step of providing each first form part includes providing a window aperture through each said discard stub; and the variable information that is printed on each second form part in said non-impact printing step includes a intended recipient's name and address so positioned on said one face of each said second form part as to be visible through the respective window aperture upon performing said juxtaposing step.

31. A two-part mailer with a return envelope, comprising:

a first part, including:

a top sheet having a front face and a rear face;

an intermediate sheet having a front face and a rear face;

securement means joining said front face of said intermediate sheet to said rear face of said top sheet along a generally C-shaped band so that a first portion of the top sheet is disposed in facewise juxtaposition with a first portion of the intermediate sheet, with the C-shaped band of securement means defining on these sheets the internal perimeter of a return envelope, with potentially open mouth of such return envelope being defined between opposite limbs of said C-shaped band of securement means;

a second portion of said top sheet adjoining said first portion thereof outside said C-shaped band of securement and extending beyond a perimetrical edge of said intermediate sheet;

means defining a window aperture through said second portion of said top sheet beyond said perimetrical edge of said intermediate sheet;

two complementary C-shaped bands of deactivated, activatable adhesive disposed on at least one of said rear faces of said top and intermediate sheets, these two bands being arranged to form a hollow generally rectangular figure which collectively jointly perimetrically rings said return envelope and said window aperture;

at least one field of constant information printed on at least one of said top sheet and intermediate sheet; and a seoond part, inoluding:

a bottom sheet having a front face and a rear face;

this bottom sheet being of sufficient size and shape as to permit facewise juxtaposition of said two complementary C-shaped bands of adhesive with said front face thereof substantially completely about the perimetrical extent of said generally rectangular figure;

this bottom sheet being adapted to be printed with information including at least one field of variable information located so as to be visible through said window aperture upon such juxtapositon of said two complementary C-shaped bands of adhesive with said front face of said bottom sheet.

32. The two-part mailer of claim 1, wherein:

said top sheet and said bottom sheet are substantially the same in size and outer perimetrical figure.

33. The two-part mailer of claim 2, wherein:

said top sheet, said intermediate sheet and said bottom sheet all are substantially rectangular in outer perimetrical figure, each having a left edge, a right edge, a top edge and a bottom edge;

said two complementary C-shaped bands of deactivated, activatable adhesive both being disposed on said rear face of said top sheet; and the top edge, the bottom edge and left edge and right edge of said intermediate sheet being located more centrally of said first part of said mailer than said two complementary C-shaped bands of deactivated activatable adhesive.

34. The two-part mailer of claim 33, wherein:

said first part is but one of a plurality of substantially identical such first parts disconnectably connected to one another in a longitudinally extending series, along respective transverse lines of weakness provided at the top and bottom edges of said top sheet.

35. The two-part mailer of claim 34, wherein:

said second part is but one of a plurality of substantially identical such second parts disconnectably connected to one another in a longitudinally extending series along respective transverse lines of weakness provided at the top and bottom edges of said bottom sheet.

36. The two-part mailer of claim 33, wherein:

said second part is but one of a plurality of substantially identical such second parts disconnectably connected to one another in a longitudinally extending series along respective transverse lines of weakness provided at the top and bottom edges of said bottom sheet.

37. The two-part mailer of claim 31, wherein:

said top sheet, said intermediate sheet and said bottom sheet all are substantially rectangular in outer perimetrical figure, each having a left edge, a right edge, a top edge and a bottom edge.

38. The two-part mailer of claim 37, further including:

a patch of translucent material secured to said rear face of said top sheet marginally of said window aperture and providing flexible glazing for said window aperture.

39. The two-part mailer of claim 37, wherein:

said securement means joining said front face of said intermediate sheet to said rear face of said top sheet along said generally C-shaped band is constituted by cold glue.

40. The two-part mailer of claim 37, wherein:

said securement means joining said front face of said intermediate sheet to said rear face of said top sheet along said generally C-shaped band opens towards one of said left edge and said right edge of said intermediate sheet.

41. A two-part mailer with a return envelope, comprising:

a first part, including:

a top sheet having a front face and a rear face;

an intermediate sheet having a front face and a rear face;

securement means joining said front face of said intermediate sheet to said rear face of said top sheet along a generally C-shaped band so that a first portion of the top sheet is disposed in facewise juxtaposition with a first portion of the intermediate sheet, with the C-shaped band of securement means defining on these sheets the internal perimeter of a return envelope, with potentially open mouth of such return envelope being defined between opposite limbs of said C-shaped band of securement means;

a second portion of said top sheet adjoining said first portion thereof outside said C-shaped band of securement and extending beyond a perimetrical edge of said intermediate sheet;

two complementary C-shaped bands of deactivated, activatable adhesive disposed on at least one of said rear faces of said top and intermediate sheets, these two bands being arranged to form a hollow generally rectangular figure which collectively jointly perimetrically rings said return envelope and borders said second portion of said top sheet;

at least one field of constant information printed on at least one of said top sheet and intermediate sheet; and a second part, including:

a bottom sheet having a front face and a rear face;

this bottom sheet being of sufficient size and shape as to permit facewise juxtaposition of said two complementary C-shaped bands of adhesive with said front face thereof substantially completely about the perimetrical extent of said generally rectangular figure;

this bottom sheet being adapted to be printed with information including at least one field of variable information located so as to be coincident with said second portion of said top sheet upon such juxtaposition of said two complementary C-shaped bands of adhesive with said front face of said bottom sheet.

42. The two-part mailer of claim 41, wherein:

said top sheet, said intermediate sheet and said bottom sheet all are substantially rectangular in outer perimetrical figure, each having a left edge, a right edge, a top edge and a bottom edge.

43. The two-part mailer of claim 42, wherein:

said securement means joining said front face of said intermediate sheet to said rear face of said top sheet along said generally C-shaped band opens toward one of said left edge and said right edge of said intermediate sheet.

44. The two-part mailer of claim 41, wherein:

said top sheet, said intermediate sheet and said bottom sheet all are substantially rectangular in outer peri-metrical figure, each having a left edge, a right edge, a top edge and a bottom edge;

said two complementary C-shaped bands of deactivated, activatable adhesive both being disposed on said rear face of said top sheet; and the top edge, the bottom edge and left edge and right edge of said intermediate sheet being located more centrally of said first part of said mailer than said two complementary C-shaped bands of deactivated activatable adhesive.

* * * * *